US007032938B2

(12) United States Patent
Kachouh

(10) Patent No.: US 7,032,938 B2
(45) Date of Patent: Apr. 25, 2006

(54) MOTOR VEHICLE DOOR LOCK

(75) Inventor: Checrallah Kachouh, Dortmund (DE)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 74 days.

(21) Appl. No.: 10/684,255

(22) Filed: Oct. 10, 2003

(65) Prior Publication Data

US 2004/0130163 A1 Jul. 8, 2004

(30) Foreign Application Priority Data

Oct. 14, 2002 (DE) ..... 102 47 843

(51) Int. Cl.
*E05C 3/06* (2006.01)

(52) U.S. Cl. ..... 292/201; 292/144; 292/216; 292/DIG. 23

(58) Field of Classification Search ..... 292/201, 292/216, DIG. 23, 144
See application file for complete search history.

(56) References Cited

U.S. PATENT DOCUMENTS

| | | | | |
|---|---|---|---|---|
| 4,664,430 | A * | 5/1987 | Bernard | 292/201 |
| 4,723,454 | A * | 2/1988 | Periou et al. | 74/89.25 |
| 4,796,932 | A * | 1/1989 | Tame | 292/112 |
| 5,409,277 | A * | 4/1995 | Rogers et al. | 292/336.3 |
| 5,649,726 | A | 7/1997 | Rogers, Jr. et al. | |
| 5,951,070 | A * | 9/1999 | Spurr | 292/201 |
| 6,278,252 | B1 * | 8/2001 | Kachouh | 318/466 |
| 6,290,269 | B1 * | 9/2001 | Bodley-Scott et al. | 292/216 |
| 6,439,624 | B1 * | 8/2002 | Spurr | 292/201 |
| 6,526,790 | B1 * | 3/2003 | Wegner | 70/277 |
| 6,557,911 | B1 * | 5/2003 | Nelsen et al. | 292/216 |
| 6,648,380 | B1 * | 11/2003 | Szablewski et al. | 292/201 |
| 6,698,300 | B1 * | 3/2004 | Swan | 74/89.18 |
| 6,712,407 | B1 * | 3/2004 | Duriez | 292/201 |
| 6,938,507 | B1 * | 9/2005 | Fisher | 74/89.16 |

FOREIGN PATENT DOCUMENTS

| | | | |
|---|---|---|---|
| DE | 197 39 340 | A1 | 3/1999 |
| GB | 2262769 | * | 6/1993 |

* cited by examiner

*Primary Examiner*—Brian E. Glessner
*Assistant Examiner*—Carlos Lugo
(74) *Attorney, Agent, or Firm*—David S. Safran

(57) ABSTRACT

A motor vehicle door lock mechanism with a drive and an operating lever, the drive including a motor and a symmetrical actuating element. The actuating element engages the operating lever so that the operating lever can be moved by the drive into different operating states. The actuating element has a number of guide tracks which correspond to a number of initial positions that are equivalent with respect to the operating state of the operating lever. The operating lever comprises a journal that fits into the guide tracks is movable by the actuating element from a first operating state into a second operating state out of an initial position. If the adjustment motion of the actuating element is not completed and the actuating element is in an intermediate position, the operating lever is manually resettable into the first operating state, into one or another of the initial positions depending on the position of the actuating element relative to first and second sides of a turning point.

12 Claims, 3 Drawing Sheets

MOTOR VEHICLE DOOR LOCK

BACKGROUND OF THE INVENTION

1. Field of the Invention

This invention is directed to a door lock mechanism. More specifically, the present invention is directed to a motor vehicle door lock mechanism including a drive and an operating lever, the drive including a motor and an actuating element.

2. Description of the Related Art

One disadvantage of conventional motor vehicle door locks is that easy manual adjustability of an operating lever associated with the lock is achieved at the cost of comparatively long and thus time-consuming initial free run of an associated actuating element, during unlocking of the door. More specifically, in the motorized shifting of the operating lever, the actuating element (e.g., a journal) must run in a guide tracks: through the widened part of a guide tracks in order to reach a channel-shaped area of the guide tracks so that a corresponding action of force on the operating lever is possible.

Attempts to solve such a problem are known as illustrated in U.S. Pat. No. 5,649,726, incorporated herein by reference, in its entirety. The motor vehicle door lock described therein employs conventional latching elements such as a lock latch and ratchet and a corresponding lock mechanism.

In the conventional motor vehicle door lock described in U.S. Pat. No. 5,649,726, the drive and actuating element have been constructed so that at least two positions (also, other embodiments show four positions) of the actuating element are equivalent with respect to the action of the actuating element on the operating lever which results in one operating state of the operating lever. The behavior of the actuating element, when placed in, the other(s) of the at least two positions, relative to the operating lever, is identical to the first position.

As a result, a long free run of the actuating element to reach this position (or operating state) is avoided since this the position is repeatedly encountered in view of the symmetrical configuration, over the adjustment range, of the actuating element. It is especially advantageous if the movement of the actuating element out of an initial position ends in another equivalent initial position.

The manual adjustability of the operating lever, especially when encountering a fault, the symmetrical configuration of the actuating element is especially advantageous. In this case the actuating element, in the course of an adjustment motion out of an initial position stops, for example, by the failure of the motor. With the actuating element having a symmetrical configuration, the actuating element can be moved into the "nearest" initial position by manually moving the operating lever.

In the above-described motor vehicle door lock, manual movement of the operating lever from a first operating state into a second operating state and vice versa is possible without moving the actuating element when the actuating element is in the initial position. The actuating element can turn about an axis, and the position of the actuating element is equivalent to the correspondingly turned position.

The actuating element of the motor vehicle door lock has a guide tracks and the operating lever has a journal which fits into the guide tracks. The guide tracks has a number of guide tracks which corresponds to the number of initial positions. Two guide tracks at a time are connected to one another via a short, radially running, transverse section. In the transverse section, the operating lever can be moved manually from the first into the second operating position and vice versa without moving the actuating element. If the drive locks in the position in which the journal is in a quadrant-shaped guide section, it is likewise possible to manually move the operating lever, but more difficult. The journal can continue to move specifically in the guide section as a result of its shape only in one direction. Optionally, the actually desired operating state is only reached via the initially unwanted operating state and subsequent resetting in the radially running transverse section.

The known motor vehicle door lock moreover has an additional structure with a free running element. The free running element is connected to the actuating element by means of a free running connection. In this way it is possible to move the operating lever manually as the actuating element is being moved, although the drive itself is self-locking.

SUMMARY OF THE INVENTION

Proceeding from the above described conventional structure, a primary object of the invention is to embody and develop the motor vehicle door lock such that manual adjustability of the operating lever with simplicity and a minimum of both path of motion and time consumption are provided.

This object of the present invention achieved, in accordance with embodiments of the invention, by providing a vehicle door lock mechanism comprising a drive and an operating lever, the drive including a motor and a symmetrical actuating element. The actuating element engages the operating lever so that the operating lever can be moved by the drive into different operating states. The actuating element includes a guide tracks having a number of guide tracks which correspond to a number of initial positions, wherein at least two positions are equivalent with respect to the operating state of the operating lever. The operating lever comprises a journal that fits into the guide tracks moving by means of the actuating element from a first operating state into a second operating state by moving the actuating element out of an initial position. If the adjustment motion of the actuating element is not completed and placed into an intermediate position, the operating lever is moved from the first operating state into the second operating state. If the actuating element is in the intermediate position, the operating lever is manually reset into the first operating state, depending upon the position of the actuating element. If the actuating element is positioned on a first side of a turning point, manually resetting moves the actuating element into the initial position, and if the actuating element is positioned on a second side of the turning point, manually resetting places the journal into the other of the two guide tracks and moves the actuating element into the other of the two initial positions.

In accordance with another feature of the invention, the implementation of the turning point between the guide tracks makes it possible to reach the initial position which is actually "nearest" at the time on the shortest path.

In accordance with another feature of the invention, the above-described manual movement of the motor vehicle door lock, which is complex in terms of the path of motion, is associated with guide sections, and at the same time, forming stops for rotary motion of the actuating element, specifically, on the radially running transverse section of the actuating element.

In accordance with yet another aspect of the present invention, an embodiment is directed to an actuating element for a motor vehicle door lock. The actuating element comprising a guide tracks wherein the guide tracks has a number of guide tracks that correspond to a number of initial positions, wherein the guide tracks each have a turning point, wherein the actuating element in an installed state is coupled to a motor and is a component of the drive and wherein the actuating element is engaged to the operating lever so that the operating lever can be moved into different operating states by the drive via the actuating element.

These and other features of the motor vehicle door lock will be readily apparent to those skilled in the art as the nature of the invention is better understood from the specification and the accompanying drawings.

DETAILED DESCRIPTION OF THE INVENTION

Figure 1:
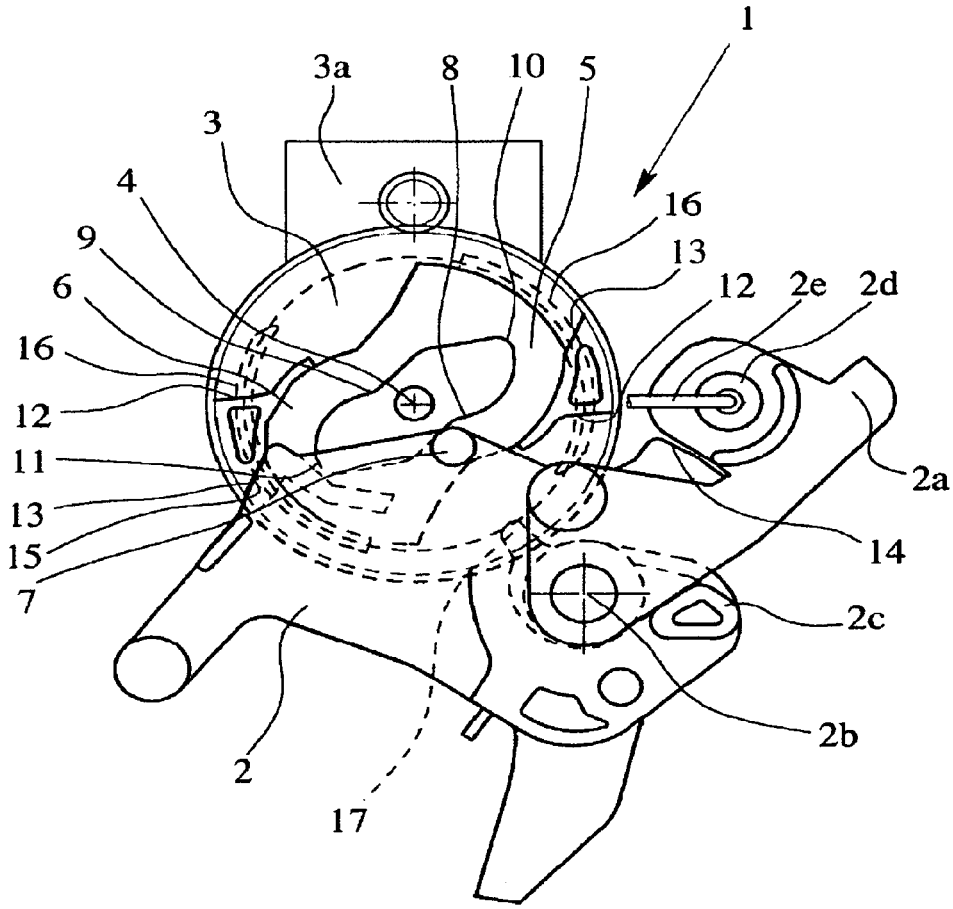
FIG. 1 shows a motor vehicle door lock in accordance with an exemplary embodiment of the present invention in a first operating state (e.g., an interlocked state)

As illustrated in the FIG. 1, an embodiment of the motor vehicle door lock of the present invention includes conventional latching elements, such as a latch, a ratchet and a lock mechanism with a central interlock arrangement 1. As previously discussed, U.S. Pat. No. 5,649,726 shows a conventional motor vehicle door lock with respect to the latch and ratchet as well as the lock mechanism. Moreover, the free running element described within the above-mentioned patent, which enables self-locking driving in conjunction with non-self locking gearing, provides yet another conventional design of a motor vehicle door lock.

The central interlock arrangement 1 contains a drive and an operating lever 2, the drive including a motor 3*a* and an actuating element 3. The operating lever 2 can be moved by the drive into different operating states. In accordance with an exemplary embodiment of the invention, the operating lever can be moved into an unlocked and into a locked state (illustrated in FIG. 1). It can also be envisioned that an operating lever 2 could be provided so as to function to be moved into more than two operating states. The actuating element 3 can engage the operating lever 2 to move the operating lever 2 via the drive, discussed in more detail below.

In accordance with an exemplary embodiment of the present invention, the actuating element 3 is symmetrical. The symmetry of the actuating element is provided so that at least two positions of the actuating element 3, which are equivalent with respect to the action of the actuating element 3 on the operating lever 2, are assigned to the operating state of the operating lever 2. In this embodiment, this is accomplished so that one position of the actuating element 3 has the same action on the operating lever 2 as the position of the actuating element 3 that is rotated 180°. Additionally, it is also possible that the actuating element could be divided into three positions separated by an angle of 120°. One advantage of such a symmetrical embodiment, as discussed above, is the reduction of a long free run for the actuating element.

Figure 3:
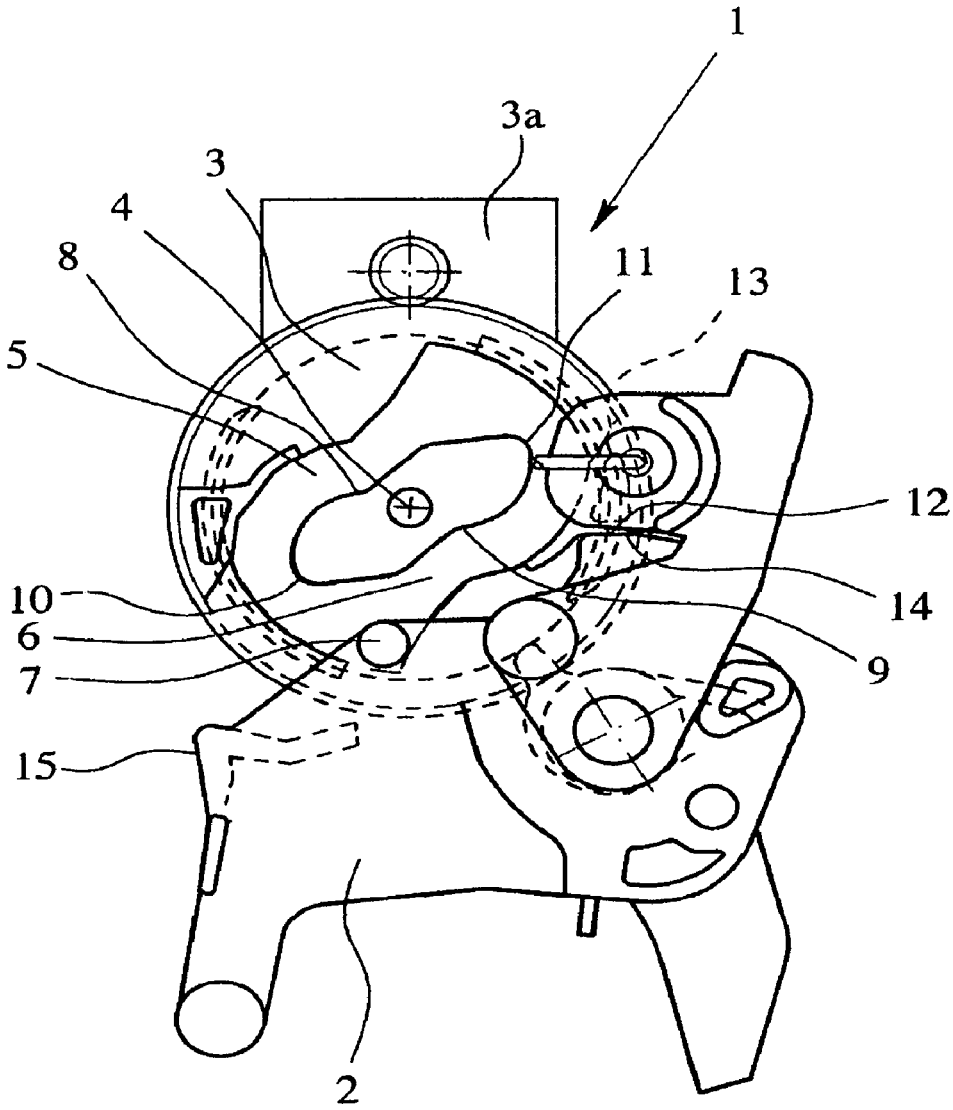
FIG. 3 shows the motor vehicle door lock illustrated in FIG. 1 in a second operating state (e.g., an unlocked state).

In accordance with the exemplary embodiment of the invention, the operating lever 2 is moved by means of the actuating element 3, from a first operating state (illustrated in FIG. 1) into a second operating state (illustrated in FIG. 3). For example, the actuating element is moved from the locked state into the unlocked state, by moving the actuating element 3 out of the initial position, where the actuating element 3 has at least two equivalent initial positions. The drawings show that the operating lever 2 can be moved out of the locked state (illustrated in FIG. 1) by the actuating element 3 being turned to the right out of the illustrated initial position. As explained above, the same state can again be reached by turning the actuating element 3 by 180°.

After motorized movement of the operating lever 2 from the first operating state to the second operating state by movement of the actuating element 3 out of the initial position, the actuating element 3 comes to rest in a second, equivalent, initial position. This can be advantageous for further actuating movements of the actuating element 3. For example, the operating lever 2 can move further with repeated actuating motion of the actuating element 3, optionally in the same actuating direction.

In the embodiment shown, the actuating element 3 is moved between the two equivalent initial positions when the operating lever 2 is moved exclusively by the motor 3*a*. Thus, a distinct advantage for manual adjustment is yielded. According to another exemplary embodiment, manual movement of the operating lever 2 is provided from the first operating state into the second operating state and vice versa, without moving the actuating element 3, is possible at least when the actuating element 3 is in the initial position. After motorized movement of the operating lever 2 out of the first into the second operating state, shown in FIGS. 1–3, (e.g., from the locked into the unlocked state) the operating lever 2 can also be moved manually back into the first operating state so that the operating lever 2 is again in the initial state and the actuating element 3 is in an equivalent initial position.

Figure 2:
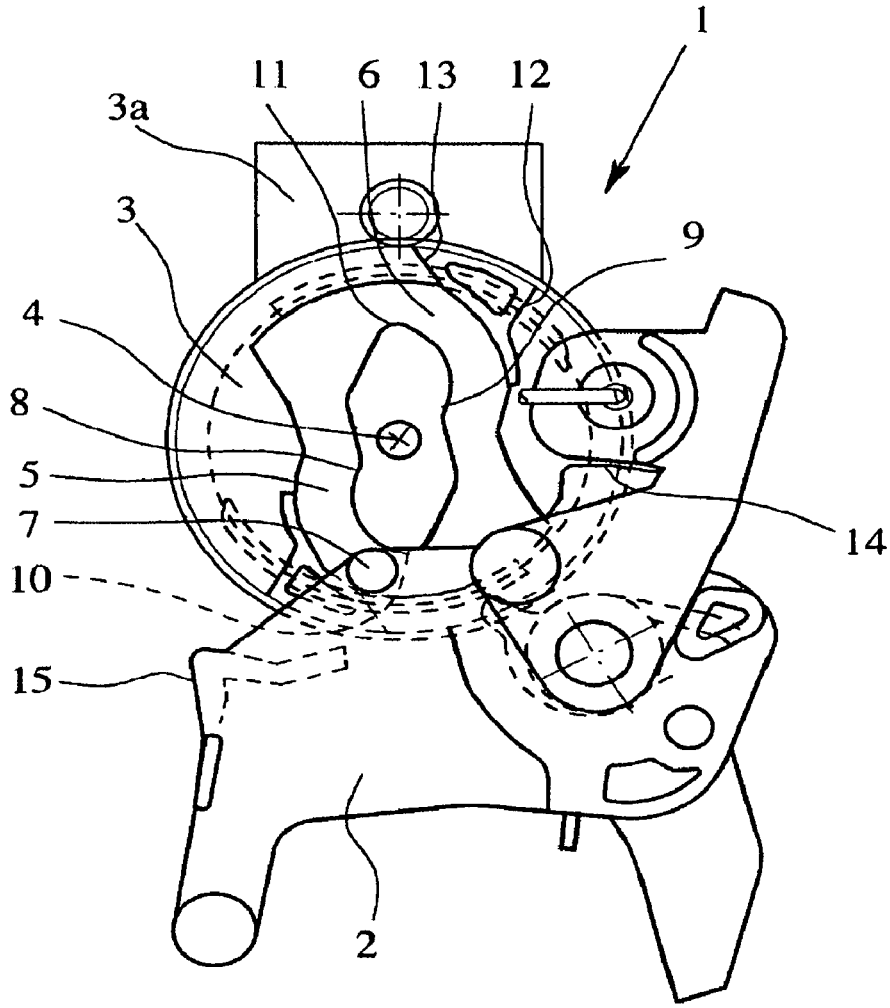
FIG. 2 shows the motor vehicle door lock illustrated in FIG. 1 in an intermediate state before reaching the turning point in accordance with an exemplary embodiment of the present invention.

FIGS. 1, 2, and 3 illustrate that, in carrying out manual actuation of the operating lever 2, an additional hand lever 2*a* is attached and is supported on the same pivot axis 2*b* as the operating lever 2. A stop buffer 2*c* fixes the additional lever 2*a* in one direction relative to the operating lever 2, but allows deflection of the additional lever 2*a* relative to the operating lever 2 when the operating lever 2 is stationary against a spring force, in case of an emergency. Coupled to the additional lever 2*a* in an eye 2*d* is a manual actuation part 2*e* which is a rod in accordance with the present invention. It can be connected, for example, to a locking cylinder (not illustrated). In any case, the manual actuation part 2*e* allows manual actuation of the operating lever 2. As illustrated in FIG. 3, the manual actuation part 2*e* allows resetting of the operating lever 2 by swiveling clockwise around the swiveling axis 2*b* from the second operating state back to the first operating state.

In summary, during normal operation, due to the symmetrical configuration of the actuating element 3, the operating lever 2 which is in the first operating state regardless of whether the operating lever 2 has been moved there manually or by the motor 3*a*, can be moved out of the initial position into the second operating state by moving the actuating element 3.

In another exemplary embodiment of the invention, the operating lever 2 can be moved from the first operating state into the second operating state by moving the actuating element 3 out of the initial state with minimum initial free running. Thus, in conjunction with the above described symmetrical configuration of the actuating element 3, this results in that the motorized movement of the operating lever 2 from the first state into the second operating state is fundamentally possible with minimum free running and thus with minimum time consumption regardless of whether the operating lever has been moved manually or by the motor 3*a* into the first operating state.

This approach is not limited to certain structural configurations. The following relates to a rotary actuating element 3, but can be applied to all other structural configurations of actuating elements known from the prior art. For example, cylindrical or drum-like actuating elements can likewise be constructed in the same manner.

In this embodiment one position of the actuating element 3 when compared to this position turned by 180° is equivalent, as discussed above. Thus, the actuating element 3 is divided into two component areas which are symmetrical to one another, each component area extending 180°. It is also possible that a component area extends less than 180°, for example, 90°. The geometrical boundary conditions enable symmetrical actuating elements as long as entire range of motion of 360° of the actuating element 3 can be divided by the angular amount of one component area.

There are numerous possible configurations for the specific manner of engagement between the actuating element 3 and the operating lever 2. One possible example is to equip the actuating element 3 on the end face with journals which, relative to the axis 4 of the actuating element 3, are located at identical angular distances on the actuating element 3. The operating lever 2 then has a fork-shaped recess or the like which can be caused to engage the journals.

In accordance with the present embodiment of the invention, actuating element 3 shown in the drawings shows a guide tracks 5, 6 on the end face of the actuating element 3 and a journal 7 on the operating lever 2 which fits into the guide tracks 5, 6.

In order to be able to ensure the above-described manual adjustability of the operating lever 2, the guide tracks 5, 6 form two sections of a continuous path. For manual movement of the operating lever 2 in the normal case, the journal 7 passes from one section into the other section of the guide tracks 5, 6, as is described above.

The two guide tracks of the guide tracks 5, 6, viewed in the cross section of the actuating element 3, are essentially point-symmetrical to one another toward the middle point of the actuating element 3 through which the axis 4 of the actuating element 3 runs. It should also be pointed out that such geometrical symmetry is not absolutely necessary for implementation of the symmetry in this sense. Here, symmetry is meant in a functional respect, especially that at least two equivalent positions of the actuating element 3 are assigned to one operating state of the operating lever 2.

The guide tracks 5, 6, illustrated in the drawings, are especially advantageous in that it is possible to manually move the operating lever 2 from a first operating state into a second operating state without moving the actuating element 3. The same applies to the manual movement of the operating lever from the second operating state into the first operating state. In particular, the operating lever 2 which is in the first operating state, (e.g., the locked state as illustrated in FIG. 1), can be moved into the second operating state, (e.g., the unlocked state as illustrated in FIG. 3) without moving the actuating element 3 by swiveling the operating lever 2 counterclockwise. The guide tracks 5, 6 have the corresponding recesses for this function.

For the actuating element 3 which is in the initial position and for the operating lever 2 which is in the first operating state, the edge 8, 9 of the guide tracks 5, 6 is positioned such that moving the actuating element 3 with minimum free running causes the operating lever 2 to move.

Especially for the case of encountering a fault condition does the illustrated embodiment of the actuating element 3 offer unique advantages. When the adjustment motion of the actuating element 3 is not completed (e.g., after failure of the motor during movement of the operating lever 2 from the first into the second state) manual resetting of the operating lever 2 into the first operating state with simultaneous movement of the actuating element 3 into the initial state is possible. In doing so, depending on the position of the actuating element 3, two versions of resetting can be implemented.

In the first version, the actuating element 3 is moved only slightly out of its initial position and the journal 7 has not yet reached a turning point 10, 11 which is formed by the guide tracks 5, 6. This position is shown in FIG. 2. Then the journal 7 remains in the respective guide track 5, 6 and then runs back in it. This resetting is caused here by manual rotation of the operating lever 2 around to the right moving from the illustration of FIG. 2 to the illustration of FIG. 1. This, in turn, leads to rotation of the actuating element 3 into the initial position (shown in FIG. 1) around to the left.

The second version of resetting takes place when the movement of the operating lever 2 by the actuating element 3, at the instant the fault occurs, has already progressed past the indicated turning point 10, 11. The journal 7 is transferred to the other of the two guide tracks 5, 6 in manual resetting so that the actuating element 3 is moved accordingly into the other of the two initial positions (to a certain extent from the illustration of FIG. 3 to the illustration of FIG. 1).

The discussion above, regarding the manner of operation of the motor vehicle door lock, is technically equivalent to the contours of the guide tracks 5, 6 and the relative position of the journal 7 and of the swiveling axis 2*b* of the operating lever 2 to the guide section 5, 6 of the actuating element 3 implementing non-self locking coupling of the journal 7 to the guide tracks 5, 6 of the actuating element 3. The non-self locking coupling is implemented by the corresponding angles between the walls of the guide tracks 5, 6 relative to the journal 7/swivelling axis 2*b* connecting line.

It can be summarized that the symmetrical configuration of the actuating element 3 ensures the manual adjustability of the operating lever 2 without adversely affecting the following motorized movement of the operating lever 2 in any way.

In order to enable block operation for the described central interlock arrangement 1, it is provided in one preferred embodiment that the actuating element 3 has a first stop 12 and a second stop 13 and the operating lever 2 has a first counterstop 14 and a second counterstop 15. When the actuating element 3 moves out of the initial position shown in FIG. 1 of the drawings to the right, the operating lever 2 is moved into its second operating state so that the first counterstop 14 moves into the path of motion of the first stop 12, illustrated in FIG. 3. Accordingly, the adjustment motion of the actuating element 3 is blocked and the drive is turned off. With subsequent movement of the actuating element 3 to the left (moving from the operative state of FIG. 3 to the operative state of FIG. 1) the operating lever 2 is moved from the second into the first operating state. In doing so the second counterstop 15 moves into the path of motion of the second stop 13 so that in turn the adjustment motion of the actuating element 3 is blocked and the drive is turned off.

With regard to the above-described block operation, it should be pointed out that the operating lever 2 can come into contact with the stops 12, 13 of the actuating element 3 via its counterstops 14, 15 and thus block the actuating element 3. If the counterstop 14; 15 is located outside the path of motion of the corresponding stop 12, 13, this stop 12, 13 is free from the operating lever 2 and can be moved past the operating lever 2 especially by the corresponding movement of the actuating element 3.

The symmetry of the actuating element 3 extends also to the described stops 12, 13 and the counterstops 14, 15 so that in the illustrated and preferred embodiment of the present invention, the stops 12, 13 which are located on the actuating element 3 are doubled, the corresponding stops preferably being made essentially point-symmetrical to one another.

The arrangement of the stops 12, 13 on the actuating element 3 is not arbitrary. In accordance with an exemplary embodiment of the invention, stops 12, 13 are located outside radially relatively far, preferably as far as possible. This yields a large lever arm for the stops 12, 13 with respect to the axis 4 of the actuating element 3. The braking action is therefore optimized.

Another teaching relates to the movement of the operating lever 2 by means of the actuating element 3 from the first operating state into the second operating state by moving the actuating element 3 out of the initial position, here especially the instant shortly after the start of the movement of the actuating element 3 being of interest.

According to the other conventional teachings, it is important that minimum motion of the actuating element 3 out of the initial position causes movement of the operating lever 2. The moved operating lever 2 fundamentally makes it possible to manually set back the minimally moved actuating element 3 by manual actuation of the operating lever 2 with the motor off. For this reason, there should be the corresponding coupling between the motor 3*a* and the actuating element 3 and a corresponding coupling of the actuating element 3 to the operating lever 2. This exemplary configuration ensures that even with minimum movement of the actuating element 3 manual resetting by the operating lever 2 is possible.

FIG. 1 indicates that, on the bottom of the actuating element 3, which is made here as a symmetrical driving disk, and located on the outer periphery or near the outer periphery, there are two actuating cranks 16. They are used to actuate the release lever 17 shown on the right in FIG. 1, which lies in the bottom plane, and which is pivotally mounted on the swiveling axis 2*b* of the operating lever 2. In the transition of operation states from FIG. 1 to FIG. 2, the displacement of the release lever 17 by the actuating guide 16 which is running past is recognizable. With this construction, for example, control of a corresponding micro switch can be implemented or also another chain of levers or other mechanical arrangement can be actuated.

Many modifications and variations of the present invention, in light of the disclosure above, can be made. For example, the concept of a motor vehicle door lock can also include all types of doors, such as hood and hatch locks. Furthermore, the above described approaches can also be applied to all types of drives in motor vehicle door locks. For example, the central interlock drive and an auxiliary opening drive can also be employed as drives in accordance with the present invention.

What is claimed is:

1. Motor vehicle door lock, comprising:

a lock mechanism comprising a drive and an operating lever, the drive including a motor and an symmetrical actuating element, wherein the actuating element engages the operating lever for enabling the drive to reversibly move the operating lever into different operating states, wherein the actuating element including a number of symmetrically arranged guide tracks which correspond to at least two initial positions which are equivalent with respect to action of the actuating element on an operating state of the operating lever, wherein the operating lever comprises a journal that fits into said guide tracks and is movable by means of the actuating element from a first operating state into a second operating state by moving the actuating element out of one of said initial positions, and is manually resettable into the first operating state when the operating lever is stopped in an intermediate position between the first operating state and the second operating state, and wherein the actuating element is movable by the manually resetting into a respective one of said initial positions in dependence upon which side of a turning point between tracks the actuation element is positioned, at a first side of a turning point, the manual resetting causing the journal to remain in the first guide track, the actuating element being reset into said one of the initial positions, and at a second side of the turning point, said manual resetting causing the journal to move into the other of the two tracks, the actuating element being reset into another of the initial positions; and wherein the actuating element has a first stop and a second stop, wherein the operating lever has a first counterstop and a second counterstop and wherein, after the operating lever has been moved by a corresponding movement of the actuating element, one or the first stop and the second stop comes into contact with a respective one of the first counterstop and the second counterstop for blocking motion of the actuating element.

2. Motor vehicle door lock as claimed in claim 1, wherein the guide tracks are contoured and the journal and a pivot axis of the operating lever located relative to the guide tracks of the actuating element for implementing non-self locking coupling of the journal to the guide tracks of the actuating element.

3. Motor vehicle door lock as claimed in claim 1, wherein operating lever is movable from the first operating state into the second operating state by moving the actuating element out of the initial position with minimum initial free running.

4. Motor vehicle door lock as claimed in claim 1, wherein the guide sections, viewed in the cross section through the actuating element perpendicular to the axis of the actuating element, are substantially point-symmetrical relative to one another towards a middle point of the actuating element.

5. Motor vehicle door lock as claimed in claim 1, wherein minimum movement of the actuating element out of the initial position causes movement of the operating lever and wherein, depending on the configuration of the coupling between the motor and actuating element, the engagement of the actuating element with the operating lever, with the motor switched off, the minimally moved actuating element is manually resetttable by manual actuation of the operating lever.

6. Motor vehicle door lock as claimed in claim 3, wherein minimum movement of the actuating element out of the initial position causes movement of the operating lever and wherein, depending on the configuration of the coupling between the motor and actuating element, the engagement of the actuating element with the operating lever, with the motor switched off, the minimally moved actuating element is manually resetttable by manual actuation of the operating lever.

7. Motor vehicle door lock as claimed in claim 1, wherein the stops on the actuating element lie radially to the outside of the actuating element.

8. Motor vehicle door lock as claimed in claim 3, wherein the stops on the actuating element lie radially to the outside of the actuating element.

9. Motor vehicle door lock as claimed in claim 5, wherein the stops on the actuating element lie radially to the outside of the actuating element.

10. Motor vehicle door lock as claimed in claim 1, wherein the tracks form a closed continuous path.

11. Motor vehicle door lock with a lock mechanism, a lock mechanism comprising a drive and an operating lever, the drive including a motor and an symmetrical actuating element, wherein the actuating element engages the operating lever so that the operating lever can be moved by the drive into different operating states, the actuating element including a guide tracks having a number of guide tracks which correspond to a number of initial positions at least wherein at least two positions are equivalent with respect to the operating state of the operating lever, wherein the operating lever comprises a journal movable in said guide tracks, by movement of the actuating element, from a first operating state into a second operating state from one of said initial positions, wherein the actuating element has a first stop and a second stop and the operating lever has a first counterstop and a second counterstop, and wherein, after movement of the operating lever by a corresponding movement of the actuating element, one of the first stop and the second stop contacts a respective one of the first counterstop and the second counterstop blocking motion of the actuating element.

12. Motor vehicle door lock as claimed in claim 11, wherein the stops on the actuating element lie radially outward of the actuating element.

* * * * *